US006748827B2

(12) United States Patent
Huang

(10) Patent No.: US 6,748,827 B2
(45) Date of Patent: Jun. 15, 2004

(54) ADJUSTABLE WRENCH

(75) Inventor: Hsiu-Ching Huang, Taipei (TW)

(73) Assignee: Ander Chen, Chang Hua Hsien (TW)

( * ) Notice: Subject to any disclaimer, the term of this patent is extended or adjusted under 35 U.S.C. 154(b) by 46 days.

(21) Appl. No.: 10/073,606

(22) Filed: Feb. 11, 2002

(65) Prior Publication Data

US 2003/0121376 A1 Jul. 3, 2003

(30) Foreign Application Priority Data

Dec. 31, 2001 (TW) ..... 90224678 U

(51) Int. Cl.[7] ..... B25B 13/16
(52) U.S. Cl. ..... 81/166; 81/129; 81/158
(58) Field of Search ..... 81/58–63.2, 129, 81/155–176

(56) References Cited

U.S. PATENT DOCUMENTS 3,104,570 A * 9/1963 Haenni et al. ..... 81/126
4,706,528 A * 11/1987 Inoue ..... 81/179
4,838,132 A * 6/1989 Pyles ..... 81/111
5,392,672 A * 2/1995 Larson et al. ..... 81/60
6,016,723 A * 1/2000 Hillinger ..... 81/63.1
6,029,548 A * 2/2000 Hsieh ..... 81/166
6,089,129 A * 7/2000 Huang ..... 81/133
6,240,814 B1 * 6/2001 Boyd et al. ..... 81/170

FOREIGN PATENT DOCUMENTS

DE 3229095 A1 * 2/1984 ..... B25B/13/46

* cited by examiner

*Primary Examiner*—Joseph J. Hail, III
*Assistant Examiner*—David B. Thomas
(74) *Attorney, Agent, or Firm*—Alan D. Kamrath; Nikolai & Mersereau, P.A.

(57) ABSTRACT

An adjustable wrench comprises a handle and a head extending from the handle. A jaw is mounted in a clamping space of the head and movable relative to an end of the clamping space upon operation of a knob. A clamping member is mounted to an end of the jaw. An elastic element is provided for biasing an end of the clamping member into the clamping space so as to press against a fastener in the clamping space. The adjustable wrench drives the fastener when the adjustable wrench is turned in a first direction. The adjustable wrench is turned freely without driving the fastener when the adjustable wrench is turned in a second direction opposite to the first direction.

23 Claims, 10 Drawing Sheets

ADJUSTABLE WRENCH

BACKGROUND OF THE INVENTION

1. Field of the Invention

The present invention relates to an adjustable wrench. In particular, the present invention relates to an adjustable wrench allowing free rotation in a direction opposite to the ratcheting direction.

2. Description of the Related Art

U.S. Pat. No. 5,415,064 to Chang issued on May 16, 1995 discloses an adjustable wrench. As illustrated in FIG. 1 of the drawings (corresponding to FIG. 6 of U.S. Pat. No. 5,415,064), the adjustable wrench 100 includes a head 101 having a fitting hole 102 and a groove 103, wherein the fitting hole 102 includes two fixed clamping faces 104 and 105. A rotation knob 106 is mounted in the groove 103, and an adjusting bolt 107 is extended through the rotation knob 106 with an end of the adjusting bolt 107 extending into the fitting hole 102. The end of the adjusting bolt 107 includes a movable surface 108 that is moved along an axis of the adjusting bolt 107 when the rotation knob 106 is turned. Thus, when clamping a fastener 109 in the fitting hole 102, two sides 109*a* and 109*b* of the fastener 109 press against the fixed clamping faces 104 and 105, and another side 109*c* of the fastener 109 after adjustment of the position of the movable surface 108 of the adjusting bolt 107 as a result of rotation of the rotation knob 106. Thus, the adjustable wrench 100 can be turned in either direction. However, when used in a limited space, the adjustable wrench 100 must be disengaged from the fastener 109 and then moved in a reverse direction before it is reengaged with the fastener 109.

U.S. Pat. No. 2,376,764 to Flower issued on Aug. 13, 1943 discloses an adjustable box wrench of a similar structure. As illustrated in FIG. 2 of the drawings (corresponding to FIG. 3 of U.S. Pat. No. 2,376,764), the adjustable box wrench 200 includes a head 201 having a clamping space 202 and a transverse opening 203 in which a knurled nut 205 is mounted. A screw 206 is extended through the knurled nut 205, and a jaw 207 is securely attached to an end of the screw 206 and movable in the clamping space 202 when the knurled nut 205 is turned. The clamping space 202 includes plural clamping faces 204 and 208 for engaging with sides of a fastener. However, the same drawback exists in this adjustable box wrench. Namely, when used in a limited space, the adjustable box wrench 200 must be disengaged from the fastener and then moved in a reverse direction before it is reengaged with the fastener.

SUMMARY OF THE INVENTION

An object of the present invention is to provide an adjustable wrench allowing free rotation in a direction opposite to the ratcheting direction.

In accordance with a first aspect of the invention, an adjustable wrench comprises:

a handle;

a head extending from the handle and including a clamping space having a first end and a second end;

a jaw mounted in the clamping space and movable between the first end and the second end of the clamping space, the jaw including a first end and a second end;

an adjusting means mounted to the head and operably connected to the second end of the jaw, the jaw being moved relative to the first end of the clamping space upon operation of the adjusting means;

a clamping member mounted to the first end of the jaw and including a first end and a second end; and an elastic element for biasing the first end of the clamping member into the clamping space so as to press against a fastener in the clamping space;

the adjustable wrench driving the fastener when the adjustable wrench is turned in a first direction;

the adjustable wrench being turned freely without driving the fastener when the adjustable wrench is turned in a second direction opposite to the first direction.

In accordance with a second aspect of the invention, an adjustable wrench comprises:

a handle;

a head extending from the handle and including a clamping space having a first end and a second end;

a jaw mounted in the clamping space and movable between the first end and the second end of the clamping space;

an adjusting means mounted to the head and operably connected to the second end of the jaw, the jaw being moved relative to the first end of the clamping space upon operation of the adjusting means;

a clamping member mounted to the first end of the head and including an end extending into the clamping space; and an elastic element for biasing the end of the clamping member into the clamping space so as to press against a fastener in the clamping space;

the adjustable wrench driving the fastener when the adjustable wrench is turned in a first direction;

the adjustable wrench being turned freely without driving the fastener when the adjustable wrench is turned in a second direction opposite to the first direction.

In accordance with a third aspect of the invention, an adjustable wrench comprises:

a handle;

a head extending from the handle and including a clamping space having a first end and a second end;

a jaw mounted in the clamping space and movable between the first end and the second end of the clamping space, the jaw including a first end and a second end;

an adjusting means mounted to the head and operably connected to the second end of the jaw, the jaw being moved relative to the first end of the clamping space upon operation of the adjusting means;

a first clamping member mounted to the first end of the jaw and including a first end and a second end;

a first elastic element for biasing the first end of the clamping member into the clamping space so as to press against a fastener in the clamping space;

a second clamping member mounted to the first end of the head and including an end extending into the clamping space; and a second elastic element for biasing the end of the second clamping member into the clamping space so as to press against the fastener in the clamping space;

the adjustable wrench driving the fastener when the adjustable wrench is turned in a first direction;

the adjustable wrench being turned freely without driving the fastener when the adjustable wrench is turned in a second direction opposite to the first direction.

The invention will become more apparent from the following detailed description when taken in conjunction with the accompanying drawings.

DETAILED DESCRIPTION OF THE PREFERRED EMBODIMENTS

Figure 1:
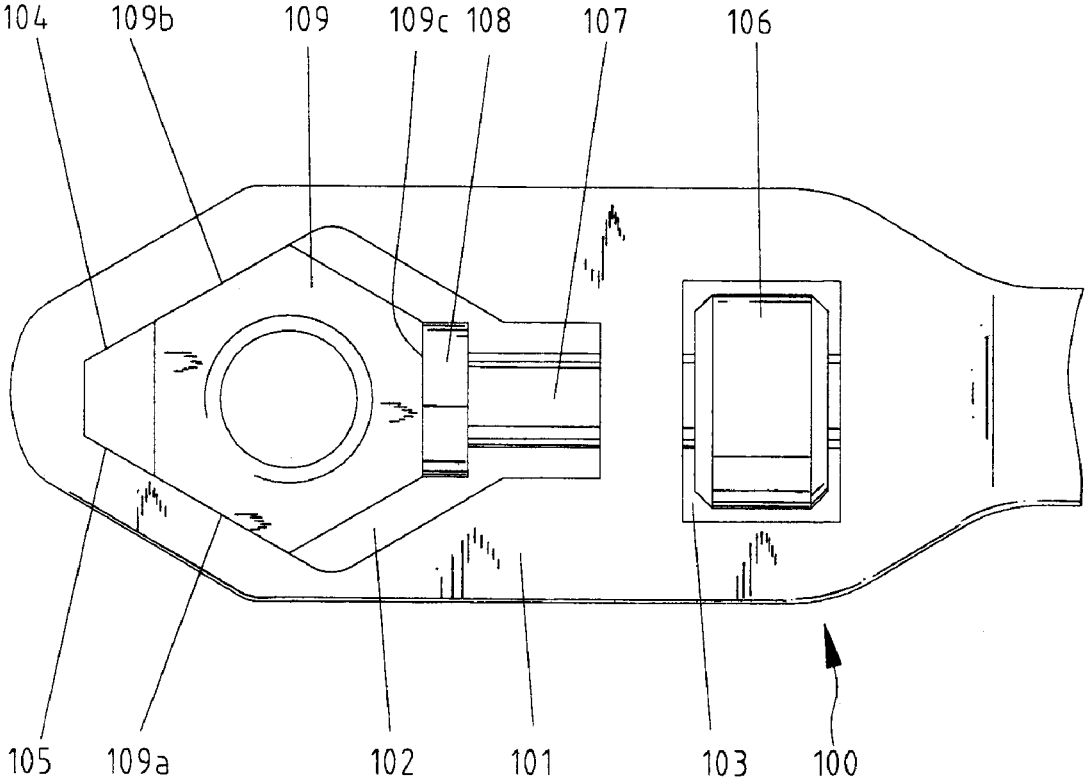
Fig. 1 PRIOR ART
FIG. 1 is a top view of a conventional adjustable wrench.
Figure 2:
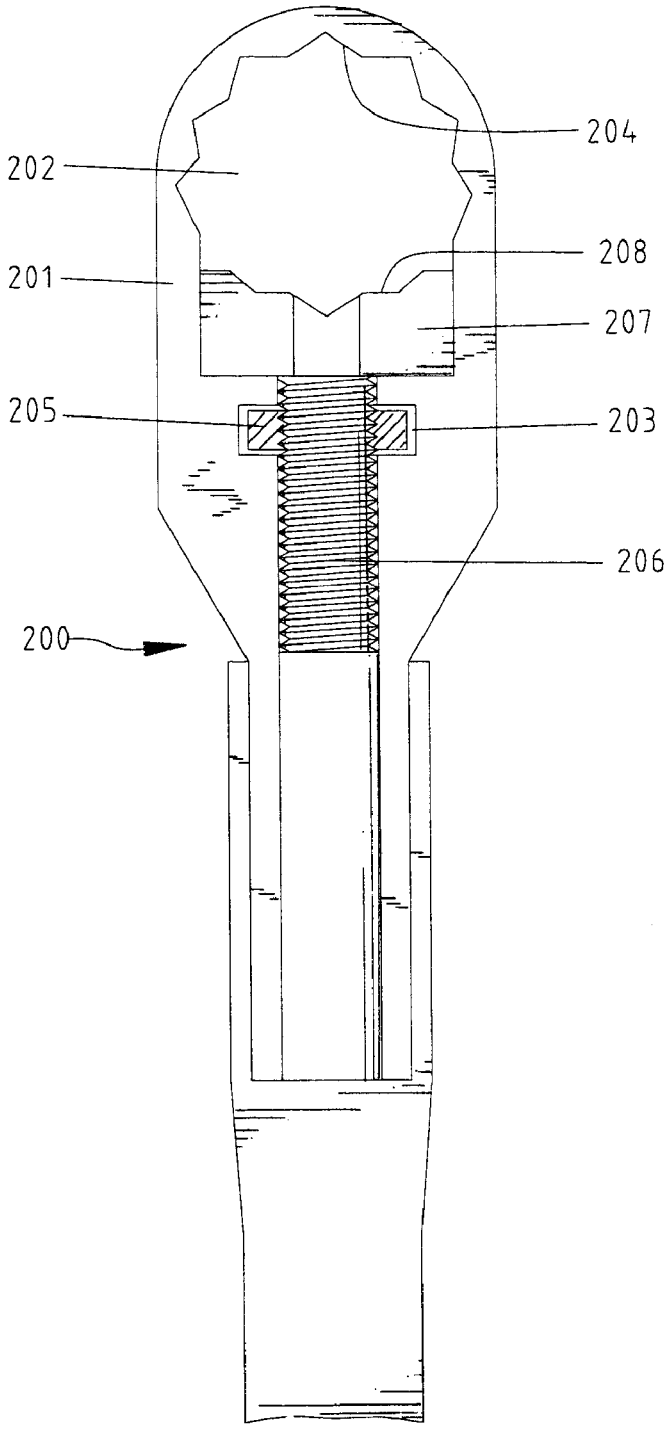
Fig. 2 PRIOR ART
FIG. 2 is a top view of a conventional adjustable box wrench.
Figure 3:
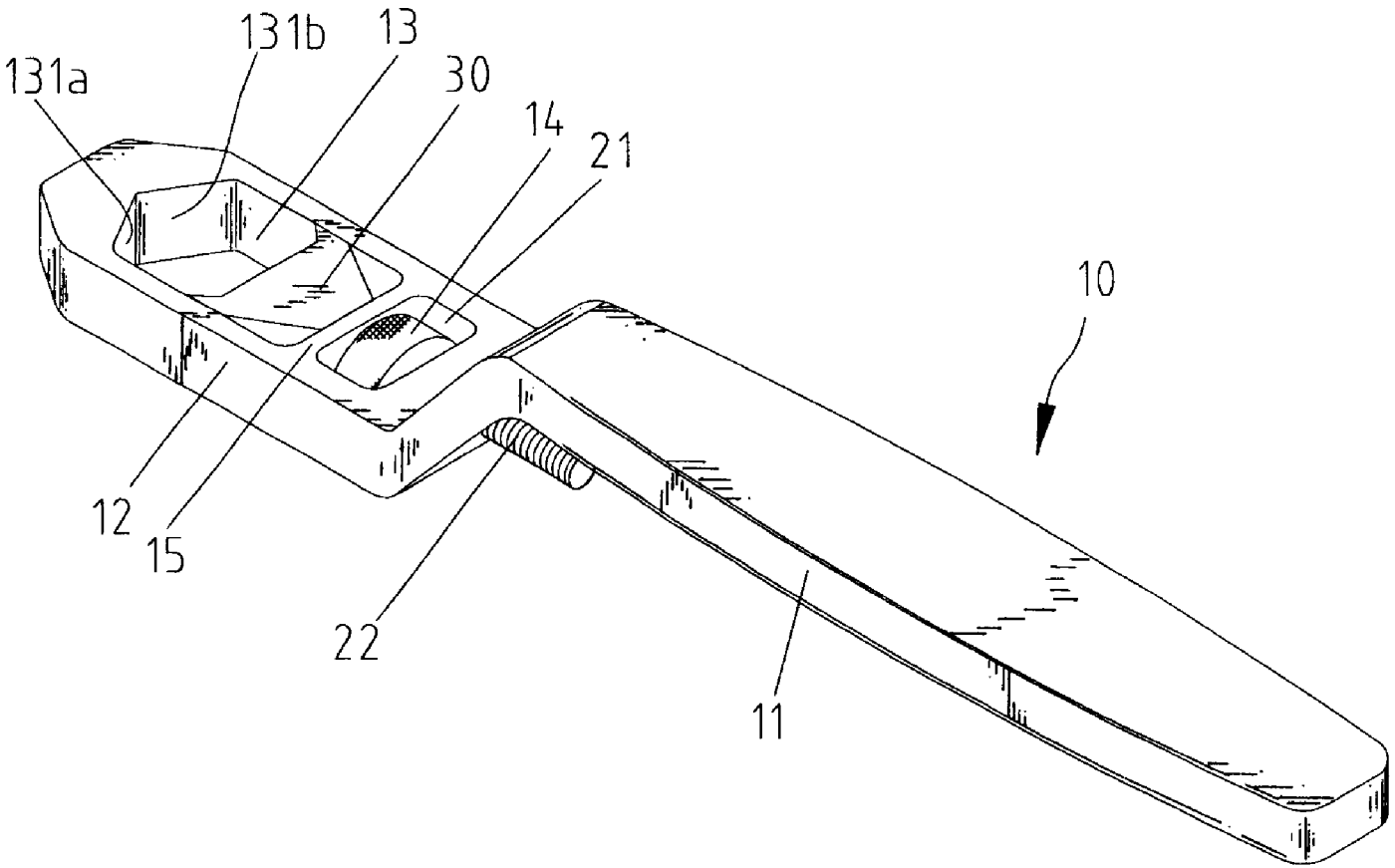
FIG. 3 is a perspective view of an adjustable wrench in accordance with the present invention.
Figure 4:
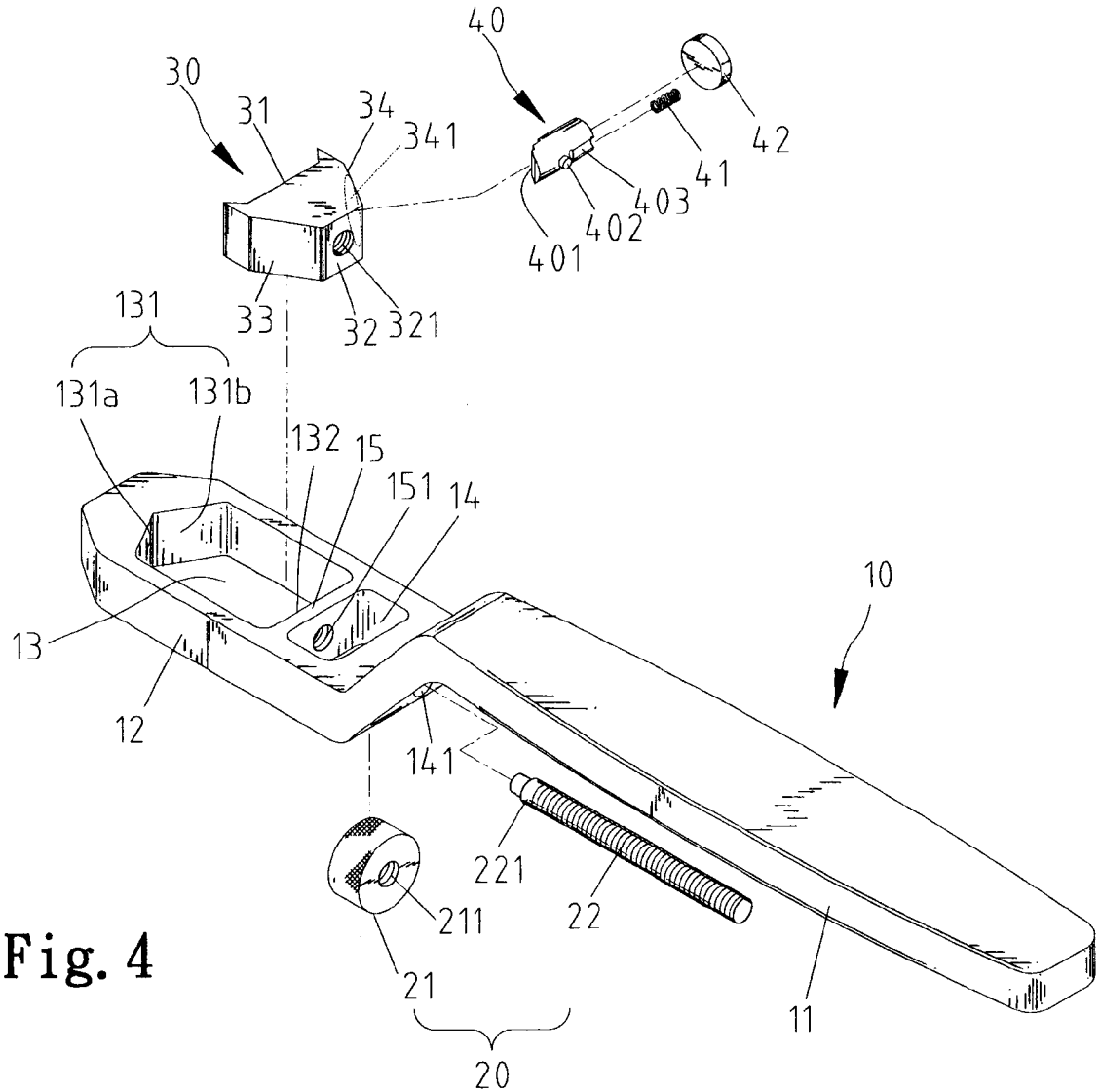
FIG. 4 is an exploded perspective view of the adjustable wrench in accordance with the present invention.
Figure 5:
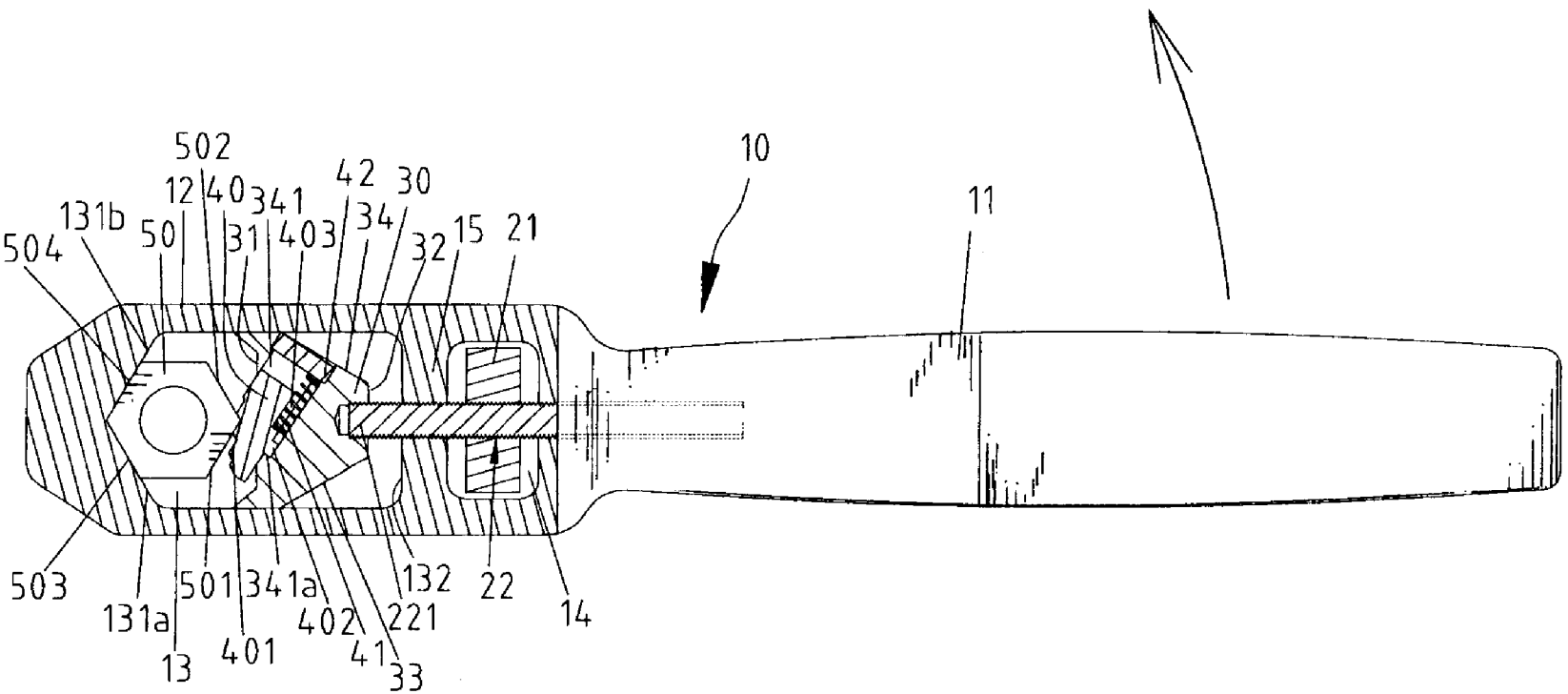
FIG. 5 is a sectional view of the adjustable wrench in accordance with the present invention.

Referring to FIGS. 3 through 5, an adjustable wrench 10 in accordance with the present invention generally comprises a handle 11 and a head 12 extending from the handle 11. A clamping space 13 and a groove 14 are defined in the head 12 and longitudinally spaced by a separation wall 15. The clamping space 13 includes a first end 131 and a second end 132, the first end 131 of the clamping space 13 including a first fixed clamping face 131*a* and a second fixed clamping face 131*b* that together form a V-shaped groove. A screw hole 151 is defined in the separation wall 15 for communicating the groove 14 with the clamping space 13. A wall that defines a portion of the groove 14 and that is opposite to the separation wall 15 includes a hole 141 aligning with the screw hole 151.

An adjusting means 20 is provided and includes a knob 21 rotatably mounted in the groove 14 and an adjusting screw 22 extended through the hole 141, a screw hole 211 in the knob 21, and the screw hole 151. Thus, when the knob 21 turns, the adjusting screw 22 moves along a longitudinal direction thereof. An end 221 of the adjusting screw 22 extends into the clamping space 13.

A jaw 30 is mounted in the clamping space 13 and securely attached to the end 221 of the adjusting screw 22 to move therewith. The jaw 30 includes a first end 31 and a second end 32 having a screw hole 321 for threading engagement with the end 221 of the adjusting screw 22. The jaw 30 further includes two sidewalls 33 and 34, wherein a mounting hole 341 is defined in the jaw 30 and extends from the sidewall 34 through the first end 31 of the jaw 30, best shown in FIG. 5. A stop 341*a* is formed on an inner periphery defining the mounting hole 341.

A clamping member 40 is mounted in the mounting hole 341 and includes a toothed first end 401 and a second end in which a groove 403 is defined for receiving an elastic element 41. The clamping member 40 includes a protrusion 402 on a side thereof. A plug 42 is mounted in the mounting hole 341 for enclosing the clamping member 40 and the elastic element 41. An end of the elastic element 41 is attached to the plug 42, and the other end of the elastic element 41 is attached to an end wall defining the groove 403. Thus, the toothed first end 401 of the clamping member 40 is biased by the elastic element 41 and thus extends beyond the first end 31 of the jaw 30 into the clamping space 13 of the head 12.

Referring to FIG. 5, when a fastener 50 is to be held in the clamping space 13 of the head 12, the knob 21 is turned to move the jaw 30 toward the fastener 50. The clamping member 40 is thus moved toward the first end 131 of the clamping space 13. The toothed first end 401 of the clamping member 40 presses against two adjacent faces 501 and 502 of the fastener 50. Further, another two adjacent faces 503 and 504 that are respectively opposite to the faces 501 and 502 respectively press against the first and second clamping faces 131*a* and 131*b*, as the clamping member 40 exerts a force to the fastener 50. Thus, the fastener 50 is securely clamped. The protrusion 402 of the clamping member 40 is stopped by the stop 341*a* in the mounting hole 341 when the former is biased by the elastic element 41 to make the toothed first end 401 of the clamping member 40 press against the faces 501 and 502 of the fastener 50. Thus, the user may turn the handle 11, e.g., counterclockwise for tightening/loosening the fastener.

Figure 6:
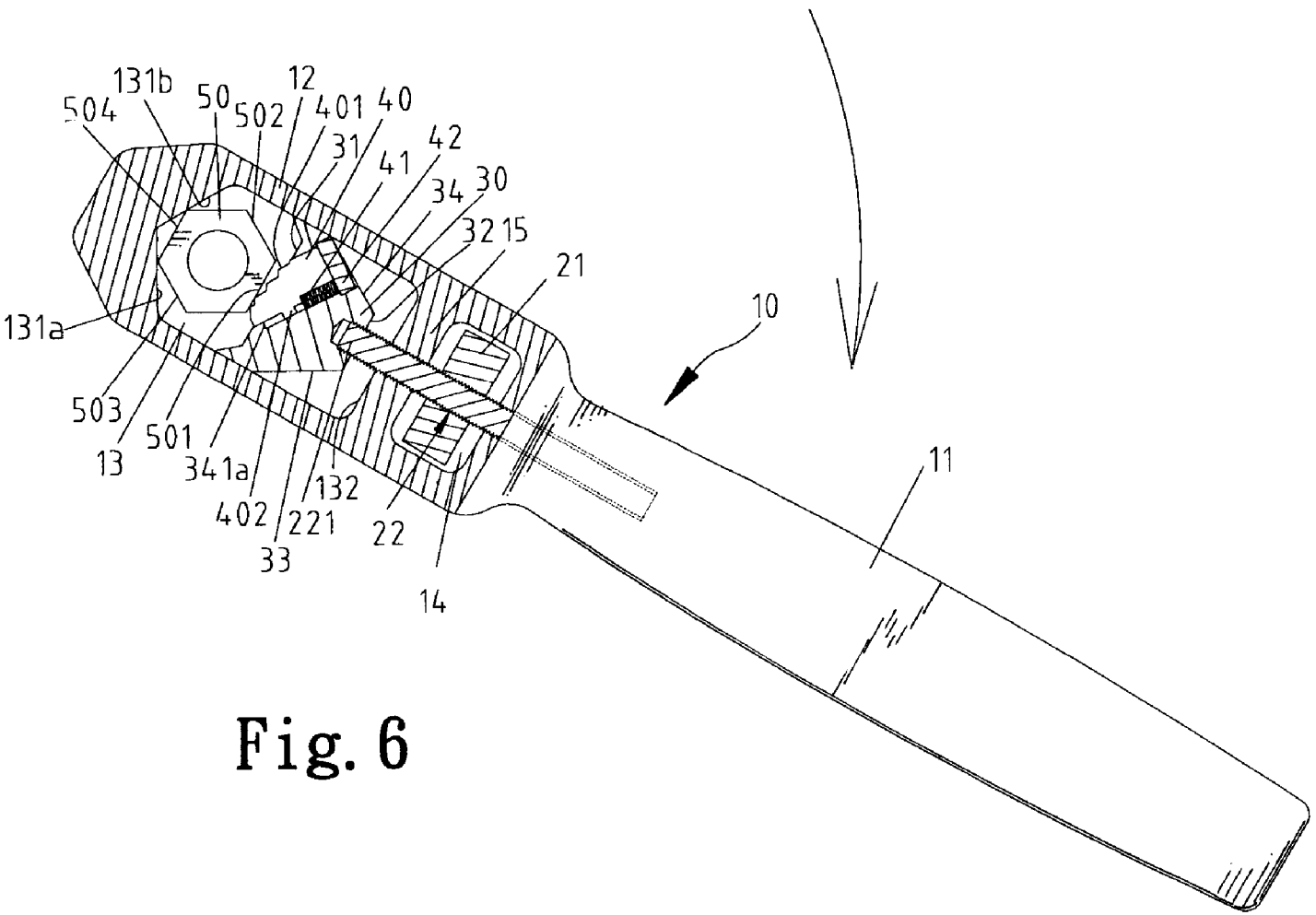
FIG. 6 is a sectional view similar to FIG. 5, illustrating operation in a reverse direction.

Referring to FIG. 6, when the handle 11 is turned in a reverse direction, e.g., clockwise, the adjustable wrench 10 turns freely; namely, the fastener 50 is not driven. This is because the clamping member 40 is not supported and thus moved away from the fastener 50 and compresses the elastic element 41. When rotation of the handle 11 stops, the clamping member 40 returns to its initial position under the action of the elastic element 41, thereby re-clamping the fastener 50. Thus, the user may drive the fastener 50 again by means of turning the handle 11 counterclockwise. Troublesome disengagement/re-engagement of the adjustable wrench from/with the fastener in the prior art is avoided.

Figure 7:
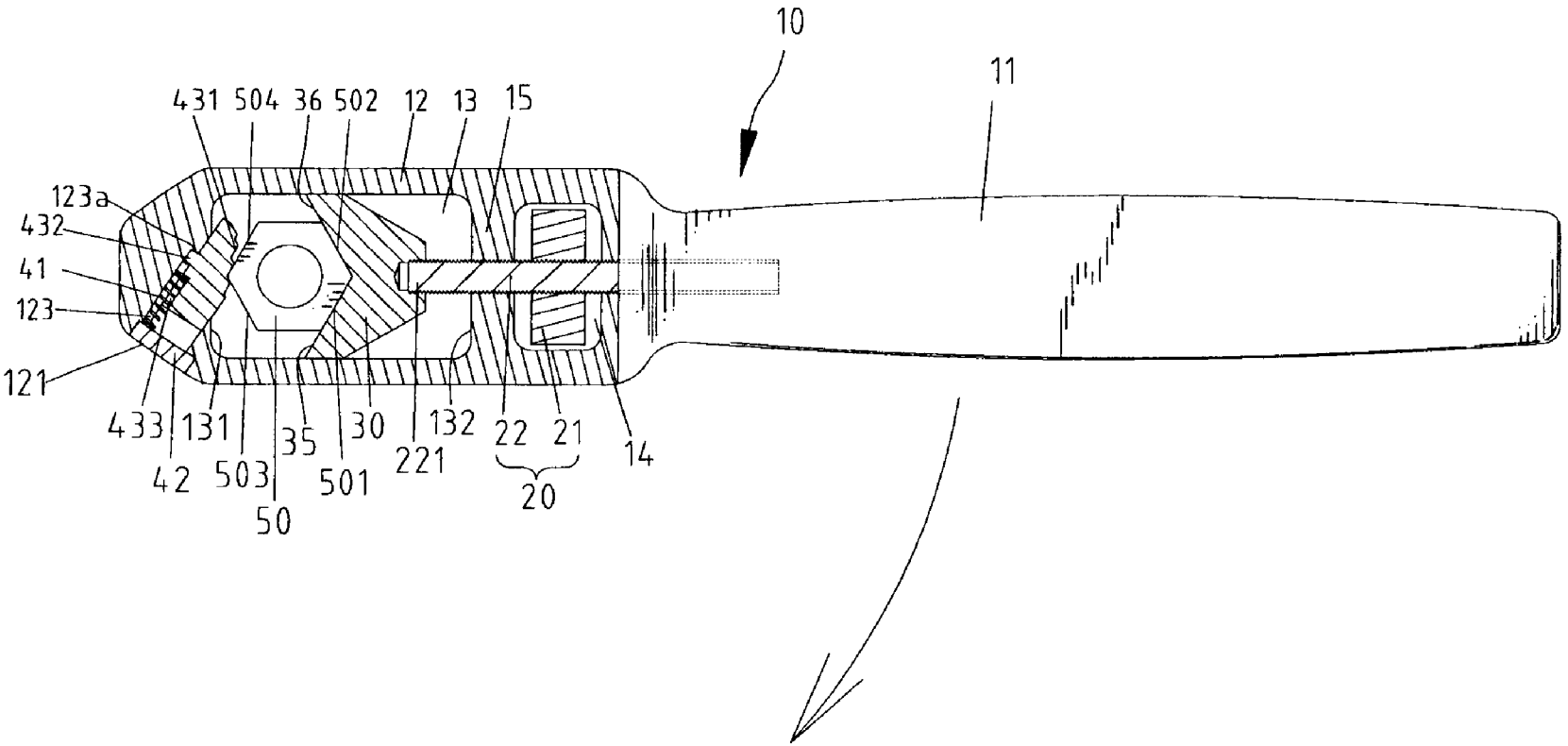
FIG. 7 is a sectional view of a modified embodiment of the adjustable wrench in accordance with the present invention.

FIG. 7 of the drawings illustrates a modified embodiment of the invention. In this embodiment, the jaw 30 has no mounting hole. Instead, the jaw 30 includes a V-shaped clamping section comprised of two adjacent clamping faces 35 and 36. The head 12 includes a mounting hole 123 defined in a side 121 thereof and communicated with the clamping space 13. A protrusion 123*a* is formed on an inner periphery defining the mounting hole 123. A clamping member 43 identical to the clamping member 40 is mounted in the mounting hole 123 and includes a toothed first end 431 extending into the clamping space 13. Further, the clamping member 43 includes a groove 433 in a second end thereof for receiving an elastic element 41. Further, the clamping member 43 includes a protrusion 432 on a side thereof for engaging with the protrusion 123*a* in the mounting hole 123.

By means of turning the knob 21, the jaw 30 on the adjusting screw 22 is moved toward the fastener 50 in the clamping space 13 of the head 12 until the clamping faces 35 and 36 press against the faces 501 and 502 of the fastener 50 while the faces 503 and 504 of the fastener 50 press against the toothed first portion 431 of the clamping member 43. Thus, the user may turn the handle 11 clockwise to tighten/loosen the fastener 50, best shown in FIG. 7. Also, the user may turn the handle 11 counterclockwise when free rotation of the handle 11 is required, best shown in FIG. 8. Ratcheting operation and free rotation operation of this embodiment are identical to those of the first embodiment shown in FIGS. 3 through 6.

Figure 9:
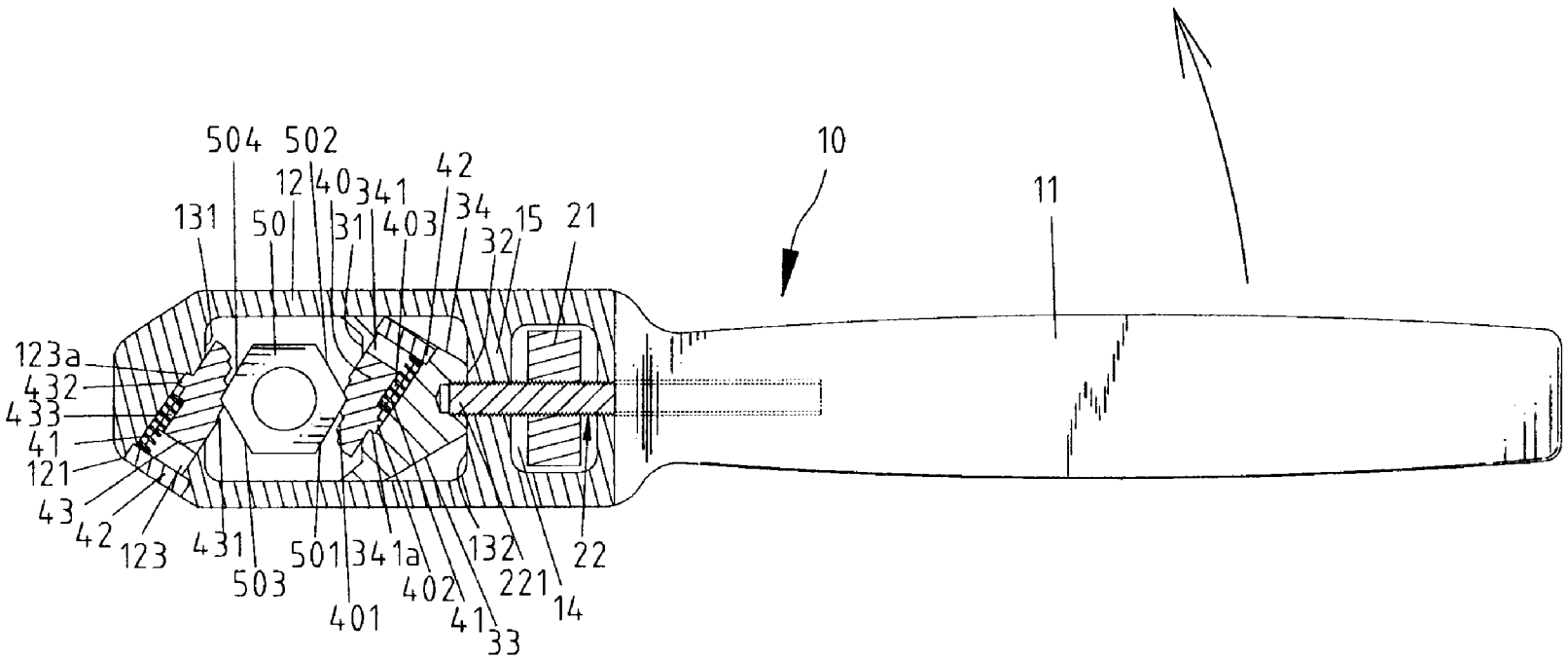
FIG. 9 is a sectional view of another modified embodiment of the adjustable wrench in accordance with the present invention.

FIG. 9 illustrates another modified embodiment of the invention. In this embodiment, the jaw 30 is identical to that in the first embodiment. Namely, the jaw 30 includes a mounting hole 341 defined in a sidewall 34 thereof and extended from the sidewall 34 through the first end 31 of the jaw 30. A stop 341*a* is formed on an inner periphery defining the mounting hole 341. A clamping member 40 is mounted in the mounting hole 341 and includes a toothed first end 401 and a second end in which a groove 403 is defined for receiving an elastic element 41. The clamping member 40 includes a protrusion 402 on a side thereof. A plug 42 is mounted in the mounting hole 341 for enclosing the clamping member 40 and the elastic element 41. An end of the elastic element 41 is attached to the plug 42, and the other end of the elastic element 41 is attached to an end wall defining the groove 403. Thus, the toothed first end 401 of the clamping member 40 is biased by the elastic element 41 and thus extends beyond the first end 31 of the jaw 30 into the clamping space 13 of the head 12.

Figure 8:
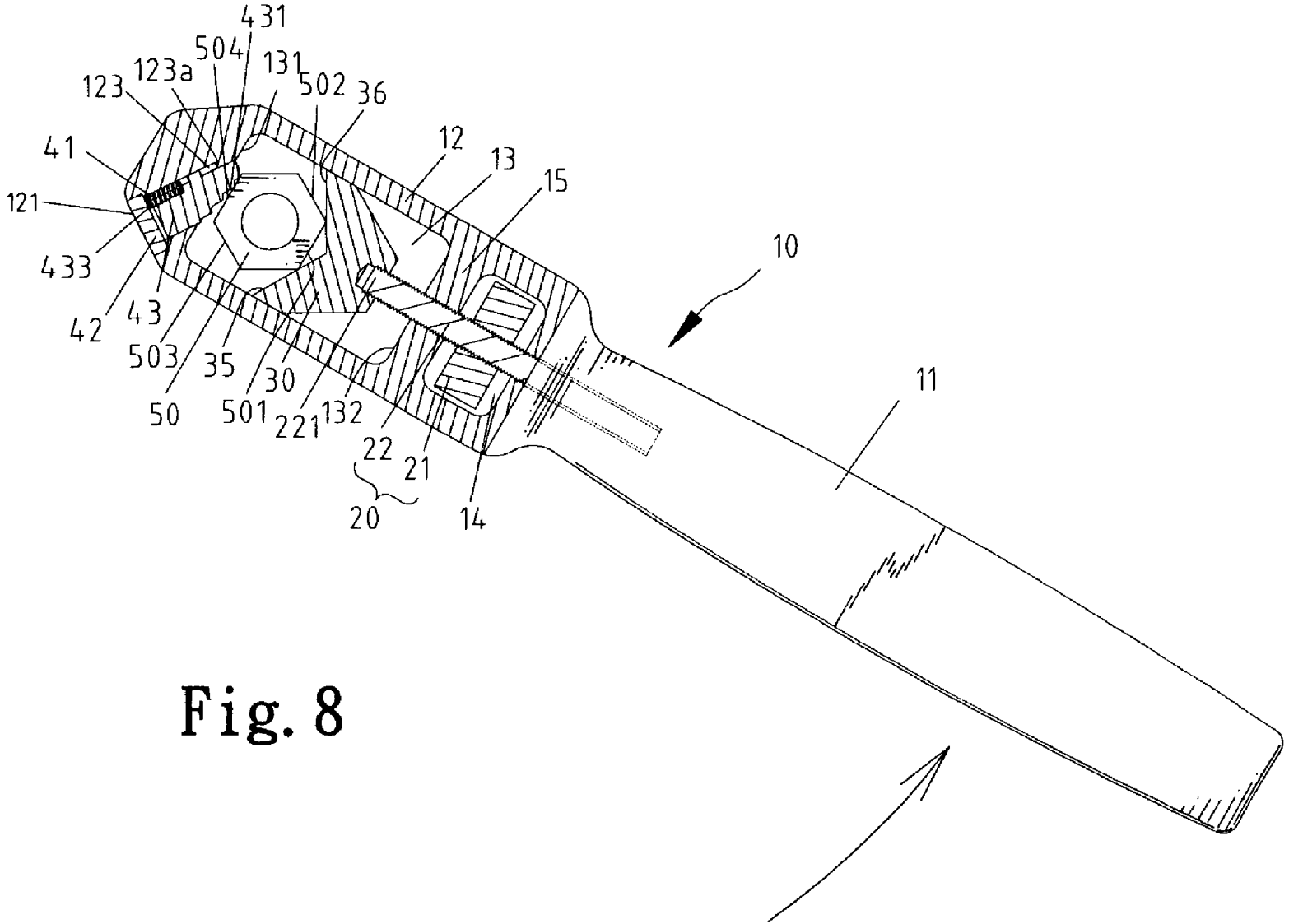
FIG. 8 is a sectional view similar to FIG. 7, illustrating operation in a reverse direction.

Further, similar to the second embodiment shown in FIGS. 7 and 8, the head 12 includes a mounting hole 123 defined in a side 121 thereof and communicated with the clamping space 13. A protrusion 123*a* is formed on an inner periphery defining the mounting hole 123. Another clamping member 43 identical to the clamping member 40 is mounted in the mounting hole 123 and includes a toothed first end 431 extending into the clamping space 13. Further, the clamping member 43 includes a groove 433 in a second end thereof for receiving an elastic element 41. Further, the clamping member 43 includes a protrusion 432 on a side thereof for engaging with the protrusion 123*a* in the mounting hole 123.

By means of turning the knob 21, jaw 30 on the adjusting screw 22 is moved toward the fastener 50 in the clamping space 13 of the head 12 until the toothed first end 401 of the clamping member 40 press against the faces 501 and 502 of the fastener 50 while the faces 503 and 504 of the fastener 50 press against the toothed first portion 431 of the clamping member 43. Thus, the user may turn the handle 11 counterclockwise to tighten/loosen the fastener 50, best shown in FIG. 9.

Figure 10:
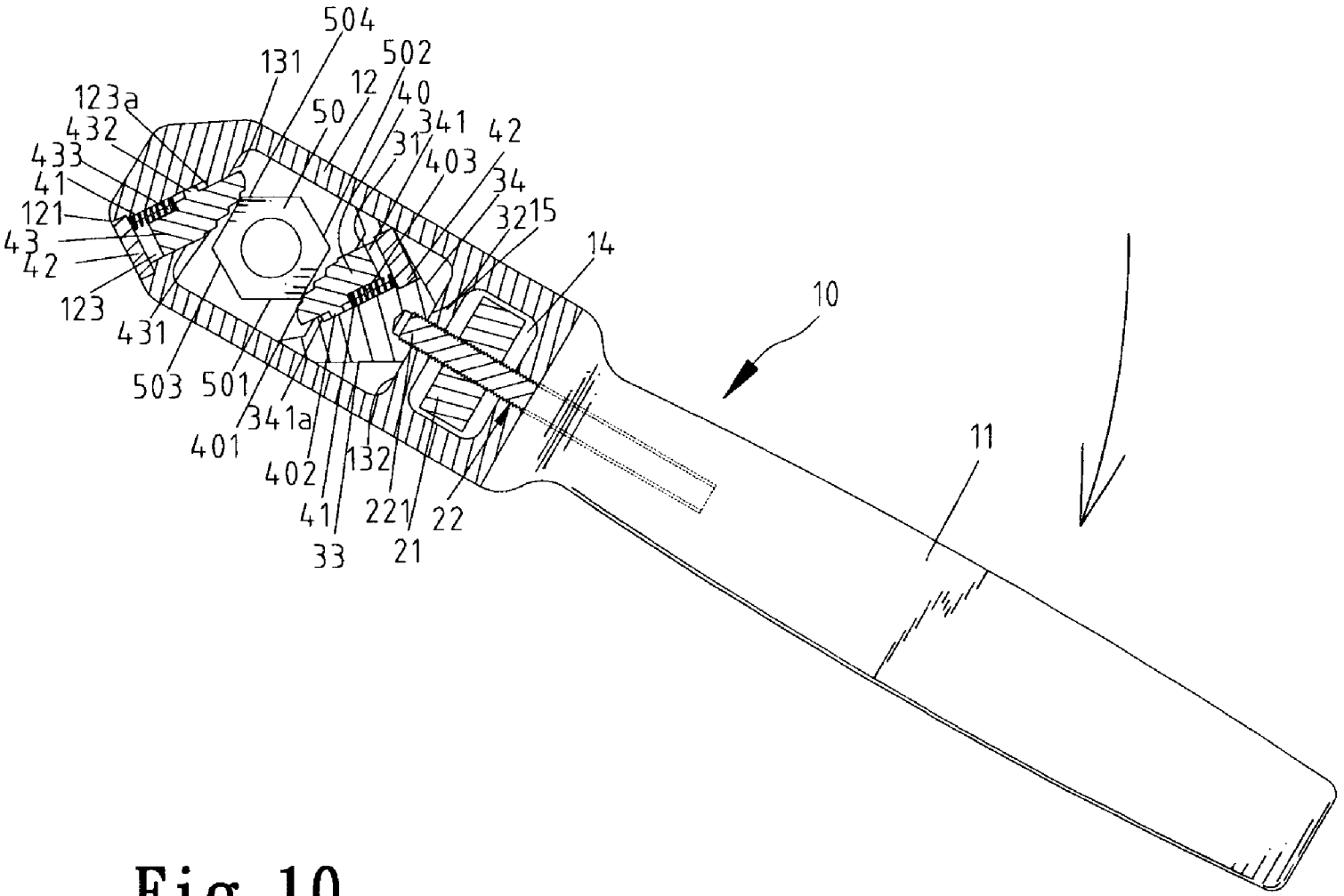
FIG. 10 is a sectional view similar to FIG. 9, illustrating operation in a reverse direction.

Referring to FIG. 10, when the handle 11 is turned in a reverse direction, e.g., clockwise, the adjustable wrench 10 turns freely; namely, the fastener 50 is not driven. This is because the clamping members 40 and 43 are not supported and thus moved away from the fastener 50 and respectively compress the elastic elements 41. When rotation of the handle 11 stops, the clamping members 40 and 43 return to their initial positions under the action of the elastic elements 41, thereby re-clamping the fastener 50. Thus, the user may drive the fastener 50 again by means of turning the handle 11 counterclockwise.

According to the above description, it is appreciated that the adjustable wrench 10 in accordance with the present invention allows free rotation in a direction reverse to the ratcheting direction, which is convenient when used in a limited space.

Although the invention has been explained in relation to its preferred embodiment, it is to be understood that many other possible modifications and variations can be made without departing from the scope of the invention as hereinafter claimed.

What is claimed is:

1. An adjustable wrench comprising:

a handle;

a head extending from the handle and including a clamping space having a first end and a second end;

a jaw mounted in the clamping space and movable between the first end and the second end of the clamping space, wherein the jaw includes an end having a first fixed clamping face and a second fixed clamping face that together form a V-shaped groove;

an adjusting means mounted to the head and operably connected to the second end of the jaw, the jaw being moved relative to the first end of the clamping space upon operation of the adjusting means;

a clamping member mounted to the first end of the head and including an end extending into the clamping space; and an elastic element for biasing the end of the clamping member into the clamping space so as to press against a fastener in the clamping space;

the adjustable wrench driving the fastener when the adjustable wrench is turned in a first direction;

with the adjustable wrench being turned freely without driving the fastener when the adjustable wrench is turned in a second direction opposite to the first direction.

2. The adjustable wrench as claimed in claim 1, wherein the adjusting means includes an adjusting screw and a knob, the head including a groove for rotatably receiving the knob, the adjusting screw extending through the knob with an end of the adjusting screw extending into the clamping space, the jaw being securely engaged with the end of the adjusting screw to move therewith such that the jaw moves along a longitudinal direction of the head when the knob is turned.

3. The adjustable wrench as claimed in claim 1, wherein the first end of the clamping member includes teeth.

4. An adjustable wrench comprising:

a handle;

a head extending from the handle and including a clamping space having a first end and a second end;

a jaw mounted in the clamping space and movable between the first end and the second end of the clamping space, the jaw including a first end and a second end;

an adjusting means mounted to the head and operably connected to the second end of the jaw, the jaw being moved relative to the first end of the clamping space upon operation of the adjusting means;

a first clamping member mounted to the first end of the jaw and including a first end and a second end;

a first elastic element for biasing the first end of the first clamping member into the clamping space so as to press against a fastener in the clamping space; and a second clamping member mounted to the first end of the head and including a first end extending into the clamping space, wherein the first end of each of the first clamping member and the second clamping member includes teeth;

a second elastic element for biasing the first end of the second clamping member into the clamping space so as to press against the fastener in the clamping space;

the adjustable wrench driving the fastener when the adjustable wrench is turned in a first direction;

the adjustable wrench being turned freely without driving the fastener when the adjustable wrench is turned in a second direction opposite to the first direction.

5. The adjustable wrench as claimed in claim 4, wherein the adjusting means includes an adjusting screw and a knob, the head including a groove for rotatably receiving the knob, the adjusting screw extending through the knob with an end of the adjusting screw extending into the clamping space, the jaw being securely engaged with the end of the adjusting screw to move therewith such that the jaw moves along a longitudinal direction of the head when the knob is turned.

6. An adjustable wrench comprising:

a handle;

a head extending from the handle and including a clamping space having a first end and a second end;

a jaw mounted in the clamping space and movable between the first end and the second end of the clamping space;

an adjusting means mounted to the head and operably connected to the second end of the jaw, the jaw being moved relative to the first end of the clamping space upon operation of the adjusting means;

a clamping member mounted to at least one of the first end of the head and the first end of the jaw, with the clamping member including an end extending into the clamping space;

an elastic element for biasing the end of the clamping member into the clamping space so as to press against a fastener in the clamping space;

a mounting hole communicated with the clamping space, the clamping member being received in the mounting hole, the elastic element being mounted in the mounting hole for biasing the end of the clamping member into the clamping space;

the adjustable wrench driving the fastener when the adjustable wrench is turned in a first direction;

with the adjustable wrench being turned freely without driving the fastener when the adjustable wrench is turned in a second direction opposite to the first direction.

7. The adjustable wrench as claimed in claim 6, with the clamping member mounted to the first end of the jaw.

8. The adjustable wrench as claimed in claim 7, wherein the adjusting means includes an adjusting screw and a knob, the head including a groove for rotatably receiving the knob, the adjusting screw extending through the knob with an end of the adjusting screw extending into the clamping space, the jaw being securely engaged with the end of the adjusting screw to move therewith such that the jaw moves along a longitudinal direction of the head when the knob is turned.

9. The adjustable wrench as claimed in claim 7, wherein the first end of the clamping space includes a first fixed clamping face and a second fixed clamping face that together form a V-shaped groove.

10. The adjustable wrench as claimed in claim 7, wherein the first end of the clamping member includes teeth.

11. The adjustable wrench as claimed in claim 7, wherein the jaw includes two sidewalls, the mounting hole extending from one of the sidewalls through the first end of the jaw.

12. The adjustable wrench as claimed in claim 11, wherein a stop is formed on an inner periphery defining the mounting hole, the clamping member including a protrusion that is stopped by the stop when the clamping member is biased by the elastic element.

13. The adjustable wrench as claimed in claim 11, further comprising a plug mounted in the mounting hole for enclosing the elastic element and the clamping member, the second end of the clamping member including a groove for receiving the elastic element, the elastic element including a first end attached to the plug and a second end attached to an end wall defining the groove of the clamping member.

14. The adjustable wrench of claim 11 further comprising a further clamping member, with the clamping member mounted to the first end of the head and the further clamping member mounted to the first end of the jaw.

15. The adjustable wrench as claimed in claim 14, wherein a stop is formed on an inner periphery defining the mounting hole, the first clamping member including a protrusion that is stopped by the stop when the first clamping member is biased by the first elastic element.

16. The adjustable wrench as claimed in claim 14, further comprising a plug mounted in the mounting hole for enclosing the first elastic element and the first clamping member, the second end of the first clamping member including a groove for receiving the first elastic element, the first elastic element including a first end attached to the plug and a second end attached to an end wall defining the groove of the first clamping member.

17. The adjustable wrench as claimed in claim 6, wherein a stop is formed on an inner periphery defining the mounting hole, the clamping member including a protrusion that is stopped by the stop when the clamping member is biased by the elastic element.

18. The adjustable wrench as claimed in claim 6, further comprising a plug mounted in the mounting hole for enclosing the elastic element and the clamping member, another end of the clamping member including a groove for receiving the elastic element, the elastic element including a first end attached to the plug and a second end attached to an end wall defining the groove of the clamping member.

19. The adjustable wrench as claimed in claim 6, wherein the first end of the head includes the mounting hole communicated with the clamping space.

20. The adjustable wrench as claimed in claim 19, wherein a stop is formed on an inner periphery defining the mounting hole, the second clamping member including a protrusion that is stopped by the stop when the second clamping member is biased by the second elastic element.

21. The adjustable wrench as claimed in claim 19, further comprising a plug mounted in the mounting hole for enclosing the second elastic element and the second clamping member, another end of the second clamping member including a groove for receiving the second elastic element, the elastic element including a first end attached to the plug and a second end attached to an end wall defining the groove of the second clamping member.

22. The adjustable wrench of claim 21 further comprising a further clamping member, with the clamping member mounted to the first end of the jaw and the further clamping member mounted to the first end of the head.

23. The adjustable wrench of claim 6 further comprising a further clamping member, with the clamping member mounted to the first end of the head and the further clamping member mounted to the first end of the jaw.

* * * * *